US005261848A

United States Patent [19]

Kaplan et al.

[11] Patent Number: 5,261,848

[45] Date of Patent: Nov. 16, 1993

[54] TOY WITH LIQUID-FILLED SHELL

[75] Inventors: Joan C. Kaplan; Edwin Kaplan, both of Englewood, N.J.

[73] Assignee: Playskool, Inc., Pawtucket, R.I.

[21] Appl. No.: 999,156

[22] Filed: Dec. 31, 1992

[51] Int. Cl.[5] ..... A63H 3/00; A63H 3/50

[52] U.S. Cl. ..... 446/74; 446/75; 446/267; 40/410; 220/665; 220/662; 472/57

[58] Field of Search ..... 446/73, 74, 75, 72, 446/267, 268; 40/410, 409; 220/665, 662; 206/45.34; 472/57, 58, 65, 67

[56] References Cited

U.S. PATENT DOCUMENTS 2,636,597 4/1953 Hinz ..... 446/73 X
4,047,633 9/1977 Trombly ..... 220/665 X
4,332,096 6/1982 Kohner et al. ..... 40/409 X
4,928,412 5/1990 Nishiyama ..... 446/267 X
5,074,417 12/1991 Kenny ..... 446/73 X

*Primary Examiner*—Mickey Yu
*Attorney, Agent, or Firm*—Salter, Michaelson & Benson

[57] ABSTRACT

A toy includes a base, a character figure on the base, and a dome-shaped housing on the base over the character figure. The housing includes inner and outer transparent shell portions which cooperate to define an enclosed cavity therebetween, and transparent liquid having sparkling particles suspended therein is received in the cavity. A second embodiment of the toy includes an opaque housing having a window therein. The window includes spaced transparent inner and outer shell portions which cooperate to define a cavity therebetween, and a transparent liquid is received in the cavity.

5 Claims, 3 Drawing Sheets

TOY WITH LIQUID-FILLED SHELL

BACKGROUND OF THE INVENTION

The instant invention relates to toys and more particularly to a toy having a liquid-filled outer shell.

Novelty items or paperweights comprising decorative articles which are disposed in liquid-filled containers have heretofore been known in the art. The U.S. Pat. No. 2,361,424 to Snyder is exemplary in this regard as disclosing a device comprising a statue figure which is mounted within a fluid filled transparent container. The fluid in the transparent container contains a white particulate matter which can be circulated within the container to simulate whirling snow around the statue.

Containers or the like comprising liquid-filled outer shell portions have also been known in the art. In this regard, the U.S. Pat. No. 1,692,938 to Jacobs; U.S. Pat. No. 3,071,888 to Knott; U.S. Pat. No. 2,272,139 to Tapner; and U.S. Pat. No. 4,525,950 to Glassman represent the closest prior art to the instant invention of which the applicant is aware. The U.S. patents to Jacobs and Knott disclose toy baby bottles which include outer shells filled with liquids. The Jacobs baby bottle comprises a glass bottle having a double-walled construction defining an open area or space therebetween, and an opaque nipple attached to the neck of the bottle The nipple communicates with the open area through a plurality of perforations in the neck of the bottle. The space is filled with a fluid resembling milk, and when the bottle is inverted, the fluid slowly drains into the nipple where it is concealed, thus creating an appearance that the fluid is being emptied from the bottle. The Knott bottle operates in a somewhat similar manner to simulate the emptying of a bottle when it is inverted. The U.S. Patent to Tapner discloses a writing instrument including a liquid-filled outer shell. The writing instrument comprises a transparent tubular shell having inner and outer concentric walls which define an elongated cavity therebetween, and a mechanical pencil. The inner working parts of the mechanical pencil are disposed within the shell, and a transparent liquid is received in the shell so that the working parts may be viewed through the shell. The U.S. Patent to Glassman discloses a flower vase for artificial flowers which is adapted to present an illusion that the vase is filled with water. The vase comprises an inner tubular insert which is sealed to an outer receptacle. The outer receptacle and the tubular insert define a cavity therebetween which is filled with a transparent fluid. In use, artificial flowers are placed in the tubular insert, and the liquid in the cavity creates an appearance that the vase is filled with water and that the flowers are received in the water.

SUMMARY OF THE INVENTION

The instant invention provides a toy comprising a liquid-filled outer shell and a character figure which is received in the shell so as to create an appearance that the character figure is received in the liquid.

Briefly, a first embodiment of the instant invention comprises a base, a character figure received on the base, a housing comprising inner and outer transparent shell portions which cooperate to define an enclosed cavity therebetween and a transparent liquid received in the cavity. The housing is removably received on the base so that the figure is disposed within the housing, and accordingly, the liquid-filled housing creates an appearance that the figure is received in the liquid.

In a second embodiment, the character figure is received in an opaque housing having an interior which simulates a living quarters of the figure. The housing includes a window comprising transparent inner and outer wall or shell portions which define an enclosed cavity therebetween, and the cavity is filled with liquid to give an appearance that the interior of the housing is filled with liquid. The figure is received in the housing and accordingly, when viewed from the exterior of the housing the figure appears to be received in the liquid.

Accordingly, it is an object of the instant invention to provide a toy which appears to comprise a character figure received within a liquid.

It is another object of the instant invention to provide a toy of this type which is amusing to young children.

It is yet another object to provide a toy which includes a character figure mounted on a base and a removable liquid-filled transparent housing on the base enclosing the character figure.

It is another object to provide a toy comprising a figure which is received in an opaque housing having a transparent liquid-filled window, wherein the housing appears to be filled with liquid when viewed through the window.

Other objects, features and advantages of the invention shall become apparent as the description thereof proceeds when considered in connection with the accompanying illustrative drawings.

DESCRIPTION OF THE DRAWINGS

In the drawings which illustrate the best mode presently contemplated for carrying out the present invention.

DESCRIPTION OF THE INVENTION

Figure 1:
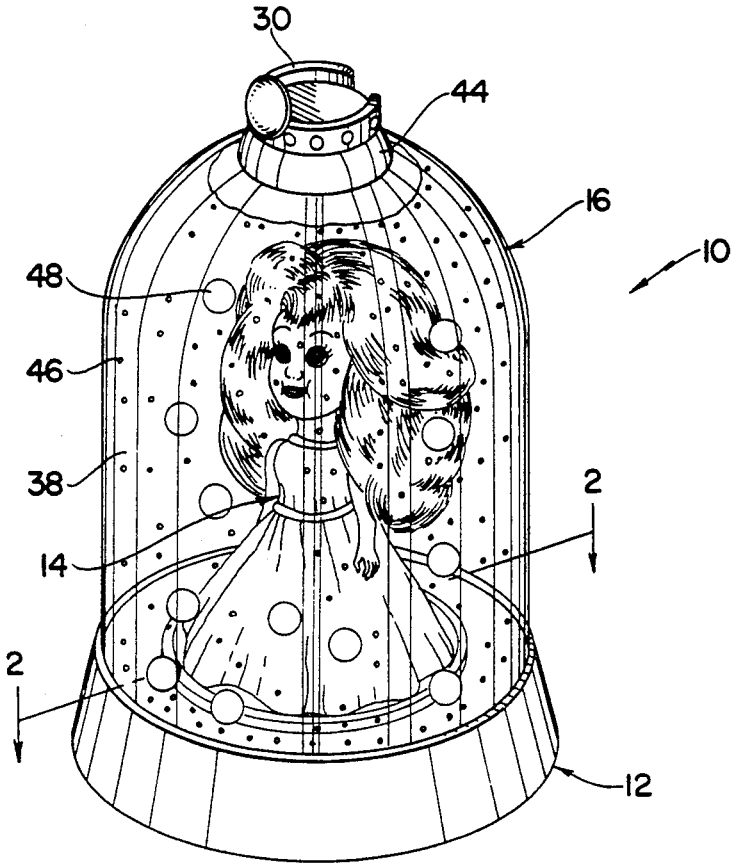
FIG. 1 is a perspective view of a first embodiment of the instant invention.
Figure 2:
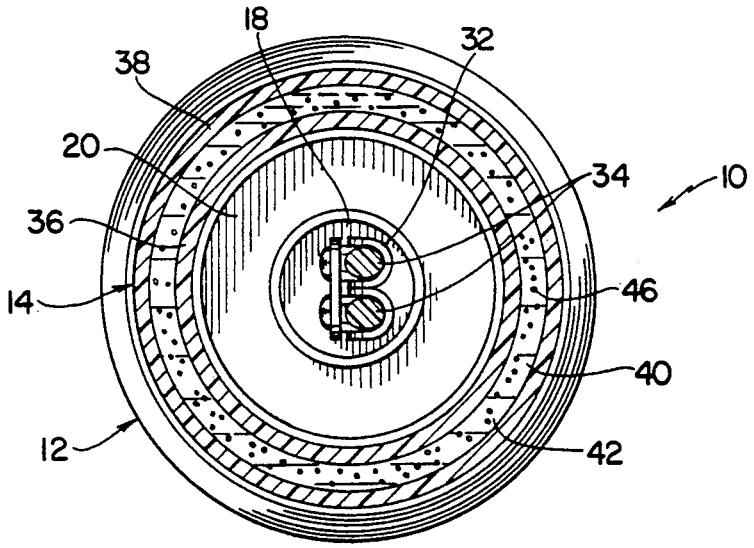
FIG. 2 is a cross sectional view thereof taken along line 2—2 of FIG. 1.
Figure 3:
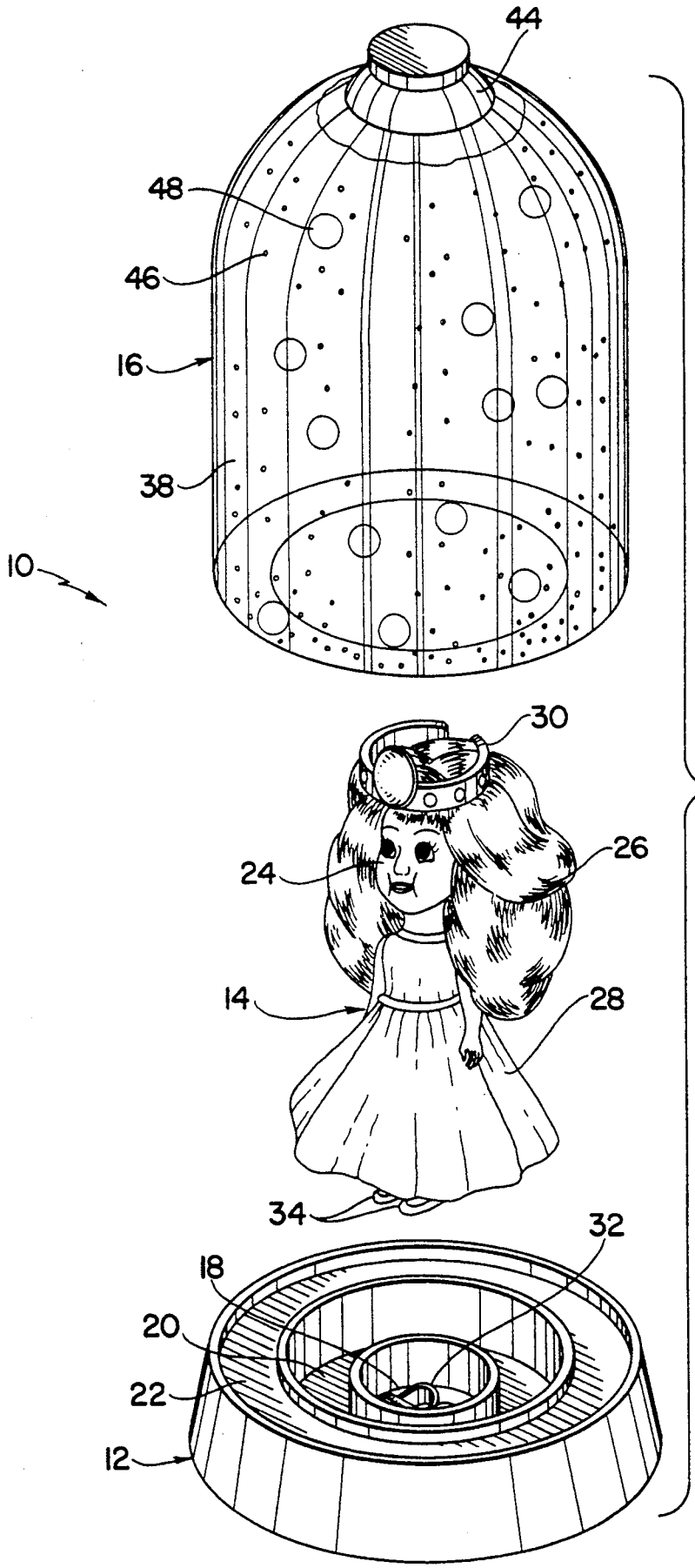
FIG. 3 is an exploded perspective view thereof.

Referring now to the drawings, a first embodiment of the toy of the instant invention is illustrated and generally indicated at 10 in FIGS. 1 through 3. The first embodiment of the toy 10 comprises a base generally indicated at 12 for supporting the toy on a supporting surface, a character figure generally indicated at 14 received on the base 12, and a transparent dome-shaped housing generally indicated at 16 which is received on the base 12 so that the figure 14 is received in the housing 16. The base 12 is preferably circular in configuration, and it includes a central cylindrical pedestal 18 for receiving the character figure 14 therein, an annular depression 20 surrounding the pedestal 18, and an outer annular channel 22 for receiving the housing 16. The character figure 14 comprises a female doll FIG. 24 having fanciful hair 26, a dress 28, and a crown 30. The central pedestal 18 includes bracing members 32 which are adapted to frictionally receive the feet 34 of the figure 14 for maintaining the figure 14 in an upright standing position when it is received on the base 12. The housing 16 comprises inner and outer dome-shaped transparent shell portions 36 and 38, respectively, which cooperate to define an enclosed cavity 40 therebetween A transparent liquid 42 is received in the cavity through an opening (not shown) in the top of the outer shell portion 38, and a cap 44 is received and secured over the opening to seal the liquid 42 in the cavity 40. The liquid 42 includes a plurality of reflective particles 46 and discs 48. As illustrated in FIGS. 1 and 3, the crown 30 is normally disposed on the cap 44 of the housing 16 when the figure 14 is received in the housing 16 (FIG. 1), and it is adapted to be worn by the figure 14 when the figure is removed from the housing 16 (FIG. 3).

In use, the feet 34 of the figure 14 are received in the bracing members 32 in the pedestal 18 of base 12, and the housing 16 is frictionally received in the outer annular channel 22 of the base 12, so that the figure 14 is positioned within the dome-shaped housing 16. Accordingly, the liquid-filled housing 16 effectively creates an appearance that the figure 14 is received in the liquid 42. When the housing 16 is shaken or inverted, the reflective particles 46 and the discs 48 are agitated so that they are suspended in the liquid 42 to create an amusing sparkling effect, although the particles 46 and discs 48 eventually resettle in the housing 16 after a period of time. Although a specific character figure 14 is illustrated in the drawings, it will be understood that a variety of other embodiments which include various different character figures are contemplated. In this regard, it is pointed out that because the housing 16 is removable from the base 12, the character figure 14 may be removed from the base 12 for play and/or replacement with another figure of similar configuration.

Figure 4:
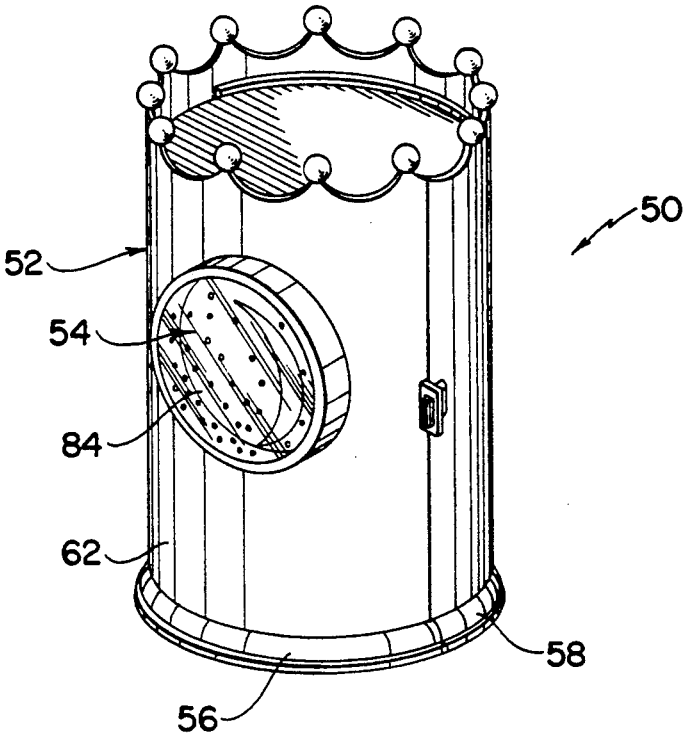
FIG. 4 is a perspective view of a second embodiment thereof in a closed position.
Figure 5:
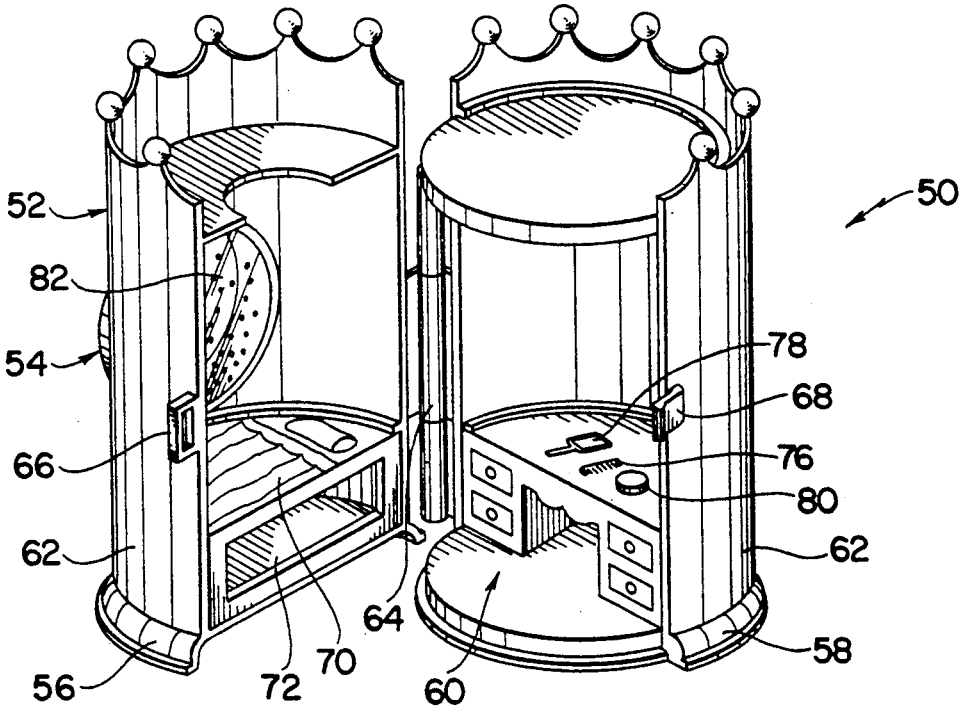
FIG. 5 is another perspective view thereof in an open position.

Referring now to FIGS. 4 and 5, a second embodiment of the toy of the instant invention is illustrated and generally indicated at 50. The toy 50 comprises a housing generally indicated at 52 and a transparent window generally indicated at 54. The housing 52 is preferably formed from an opaque plastic, and it includes first and second housing section halves 56 and 58, respectively, which cooperate to define an inner housing compartment area generally indicated at 60 and an outer wall 62. The housing 52 further includes hinge members 64 so that the housing 52 may be opened to expose the inner housing compartment area 60, and closed to conceal the inner housing compartment area 60. The first and second housing section halves 56 and 58, respectively, also include an interlocking notch 66 and a tab 68 for maintaining the housing 52 in the closed position. When the housing 16 is in the closed position, the inner housing compartment 60 may be viewed from the outside of the housing 52 through the transparent window 54. The inner housing compartment 60 is fashioned to simulate a living quarters of a character figure (not shown), such as the character 14. The first housing section half 56 includes a shelf portion 70 which is fashioned to simulate a bed, and a small storage compartment 72 is located beneath the shelf portion 70 for storing various articles of the character figure 14. The second housing section half 58 is fashioned to simulate a dressing area, including a vanity 74, and it includes various dressing articles such as a comb 76, a mirror 78, and a compact 80. The transparent window 54 comprises inner and outer shell portions 82 and 84, respectively, which cooperate to define a closed cavity therebetween. The shell portions 82 and 84 are mounted in the outer wall 62 of the first housing section half 56 so that the inner housing compartment 60 may be viewed from outside of the housing 52, and a transparent liquid is received in the cavity. The window 54 effectively creates an appearance that the inner housing compartment 60 is filled with a liquid when the housing section halves 56 and 58 are in the closed position. The window 54 also creates an appearance that a figure inside the housing compartment 60 is received in the liquid. The liquid includes a plurality of reflective particles and discs which provide an amusing sparkling effect when the housing is shaken.

It is seen therefore that the instant invention provides an amusing toy in which a character figure appears to be immersed in a liquid. In the toy 16 the liquid-filled housing 16 effectively surrounds the character figure 14 and creates an appearance that the figure 14 is received within the liquid 42. The shell is removable from the supporting base 12 so that a plurality of different character figures can be placed within the housing 16. In the second embodiment, the liquid-filled window 54 effectively creates an appearance that the housing 52 is filled with liquid.

While there is shown and described herein certain specific structure embodying the invention, it will be manifest to those skilled in the art that various modifications and rearrangements of the parts may be made without departing from the spirit and scope of the underlying inventive concept and that the same is not limited to the particular forms herein shown and described except insofar as indicated by the scope of the appended claims.

What is claimed is:

1. A toy comprising:

a base for supporting said toy on a supporting surface;

a character figure received on said base;

a housing including inner and outer transparent shell portions which cooperate to define an enclosed cavity therebetween; and a liquid received in said cavity, said housing being removably received on said base so that said figure is positioned in said housing, said liquid and said housing cooperating to create an appearance that said figure is received in said liquid.

2. In the toy of claim 1, said housing being dome-shaped.

3. In the toy of claim 1, said liquid containing a plurality of particles.

4. In the toy of claim 1, said base including a central pedestal portion for receiving said character figure and an outer annular channel for receiving said housing.

5. In the toy of claim 4, said character figure including legs and feet, said pedestal portion including bracing means for frictionally receiving the feet of said character figure and for thereby maintaining said character figure in an upright position on said base.

* * * * *